US005134382A

United States Patent [19]

Davis et al.

[11] Patent Number: 5,134,382

[45] Date of Patent: Jul. 28, 1992

[54] SUPPORT FOR MOUNTING CYLINDRICAL ELECTRICAL COMPONENTS

[75] Inventors: Gary D. Davis, Taylorsville; Michael G. Nolte; Timothy G. Tillery, both of Hickory; Robert W. Scheu, Newton; John R. Castonguay, Hickory, all of N.C.

[73] Assignee: General Electric Company, King of Prussia, Pa.

[21] Appl. No.: 743,884

[22] Filed: Aug. 12, 1991

[51] Int. Cl.[5] ..... H01H 85/02; H01H 85/20; H01H 85/50

[52] U.S. Cl. ..... 337/186; 337/213; 337/214; 337/215

[58] Field of Search ..... 337/186, 190, 207, 208, 337/213, 214, 215; 361/430; 248/309.1, 316.1; 439/620, 621, 622

[56] References Cited

U.S. PATENT DOCUMENTS 3,813,626 5/1974 Cetola et al. ..... 337/186
3,813,637 5/1974 Grebik et al. ..... 337/213
3,815,071 6/1974 Sleeter ..... 337/215

*Primary Examiner*—Harold Broome
*Attorney, Agent, or Firm*—Henry J. Policinski; William Freedman

[57] ABSTRACT

This support is for mounting on structure of electrical apparatus a fuse or other device that comprises a cylindrical tube. The support comprises a base adapted to be secured to said structure, the base having a length and a width dimension. Two legs project laterally from the base at its longitudinally-opposite ends, each leg comprising a body portion that has a proximate end and a distal end. The base and the legs are of rigid polymeric insulating material, and the body portion of each leg is integrally joined to the base at the proximate end of the body portion. At its distal end the body portion of each leg carries a flange that projects from the body portion longitudinally with respect to the base. Each flange has a concave arcuate surface facing away from the base that is adapted to receive a portion of the above cylindrical tube. The arcuate surface includes a first curved portion for receiving a relatively large diameter tube and another curved portion for receiving a relatively small diameter tube.

10 Claims, 3 Drawing Sheets

SUPPORT FOR MOUNTING CYLINDRICAL ELECTRICAL COMPONENTS

FIELD OF THE INVENTION

This invention relates to an insulating support for an electric fuse or other electrical device that comprises a cylindrical tube and, more particularly, relates to an insulating support of this type which is capable of supporting, with required clearance distances, fuses or other electrical devices having voltage ratings in the kilovolt range and having a wide variety of different tube diameters.

BACKGROUND

The type of support that we are concerned with must be capable of supporting a fuse or other electrical device in a position where electrical clearance distances about the fuse or other electrical device are sufficient to withstand thousands of volts, must be readily adaptable to use in electrical apparatus of many different designs and configurations, must be capable of effectively supporting fuses or other electrical devices having a wide variety of different tube diameters, and must be durable enough to successfully withstand without damage the shocks and other mechanical stresses produced by shipping, installation, transportation, and use of the electrical apparatus.

Prior supports intended for such applications that we are aware of have been subject to one or more of the following disadvantages. They have not been readily usable with fuses or other electrical devices having different fuse/electrical device tube diameters. They have been unduly expensive both to fabricate and to install in electrical apparatus. They have not readily lent themselves to a variety of installations which require different orientations of the tube with respect to the supporting structure of the electrical apparatus. They have not been able to successfully withstand severe mechanical stresses such as might result from inadvertent dropping of the electrical apparatus through a distance of one foot onto a concrete floor. In under-oil installations, they have not been capable of withstanding without significant degradation of their mechanical properties exposure to hot oil for the prolonged expected life-times of the electrical apparatus.

OBJECTS

An object of our invention is to provide an insulating support for a fuse or other electrical device that is suitable for voltages in the kilovolt range and is not subject to the above-described disadvantages.

Another object of our invention is to provide an insulating support to which a fuse or other electrical device may be joined without the use of metallic screws or bolts or any other electrically conductive parts in the vicinity of the fuse.

Still another object is to provide a support that comprises spaced-apart support elements for supporting the tube at spaced locations along its length but which support can be quickly installed without requiring that the support elements be aligned by the installer as part of the installation operation.

SUMMARY

In carrying out our invention in one form, we provide a support for mounting on structure of electrical apparatus an electrical fuse or other device that comprises a cylindrical tube and conductive terminals at opposite ends of the tube. The support comprises a base that is adapted to be secured to said structure, the base having a length and a width dimension. Two legs project laterally from the base at its longitudinally-opposite ends, each leg comprising a body portion that has a proximate and a distal end. The body portion is integrally joined to the base at the proximate end of the body portion and carries a flange at the distal end of the body portion that projects from the body portion longitudinally with respect to the base. The support is further characterized by (i) each flange having a concave arcuate surface facing away from the base that is adapted to receive a portion of the above cylindrical tube, (ii) the arcuate surface including a first curved portion for receiving a relatively large diameter tube and another curved portion for receiving a relatively small diameter tube, and (iii) the base and the legs being of rigid polymeric electrical insulating material.

BRIEF DESCRIPTION OF FIGURES

For a better understanding of the invention, reference may be had to the following detailed description taken in connection with the accompanying drawings, wherein.

DETAILED DESCRIPTION OF EMBODIMENT

Figure 2:
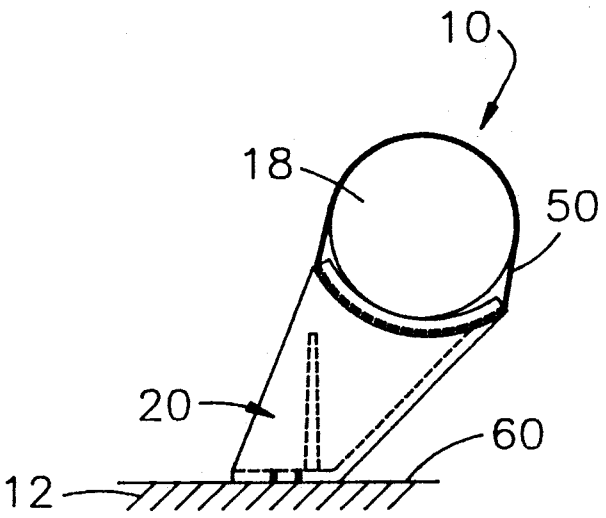
FIG. 2 is an end view of the assembly of FIG. 1.
Figure 1:
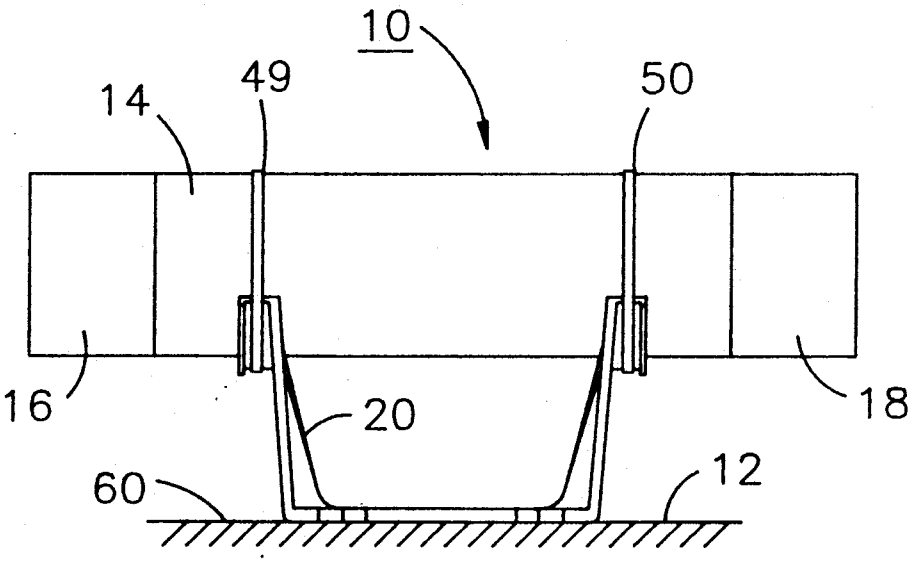
FIG. 1 is a side elevational view of an assembly comprising a fuse or other electrical device and a support embodying one form of our invention.

Referring first to FIGS. 1 and 2, there is shown an electric fuse or other electrical device 10 which it is desired to support on structure 12 of electrical apparatus, such as a distribution transformer. This structure 12 may be a wall of the transformer, its core-and-coil assembly, or some other component, depending upon the particular application involved. The fuse or other electrical device is of a conventional design and comprises a cylindrical tube 14 of electrical insulating material and conductive terminals 16 and 18 at opposite ends of the tube. Within the tube 14, if a fuse, is a conductive fuse element (not shown) and a suitable filler of silicon sand or the like surrounding the fuse element.

For supporting the fuse or other electrical device 10 on the structure 12, a one-piece insulating support 20 of rigid polymeric material is provided. This support, which is illustrated in greater detail in FIGS. 3, 4, and 5, comprises a rectangular base 24 having a length dimension L, a width dimension W, and a thickness dimension T. The base 24 contains two spaced-apart holes 25 and 26 extending through its thickness for receiving screws (not shown) that fasten the base to the adjacent support structure.

At longitudinally-opposite ends of the base 24 there are two legs 30 and 32 projecting laterally from the base. Each leg comprises a body portion 34 that has a proximate end 34*a* and a distal end 34*b*, the body portion being integrally joined to the base at the proximate end of the body portion.

Each leg further comprises an integral flange 36 at the distal end of the body portion that projects from the body portion in a direction that extends longitudinally with respect to the base. Each of the flanges 36 has a concave arcuate surface 38 facing away from the base 24 that is adapted to receive a portion of the cylindrical tube 14 of the fuse or other electrical device. The concave arcuate surfaces of the two spaced-apart legs 30 and 32 are aligned so that the cylindrical tube is readily supported at spaced-apart locations along its length by the legs. Preferably, the tube length is centered on the support 20 so that the mid-section of the tube is equidistant from the two legs.

Figure 4:
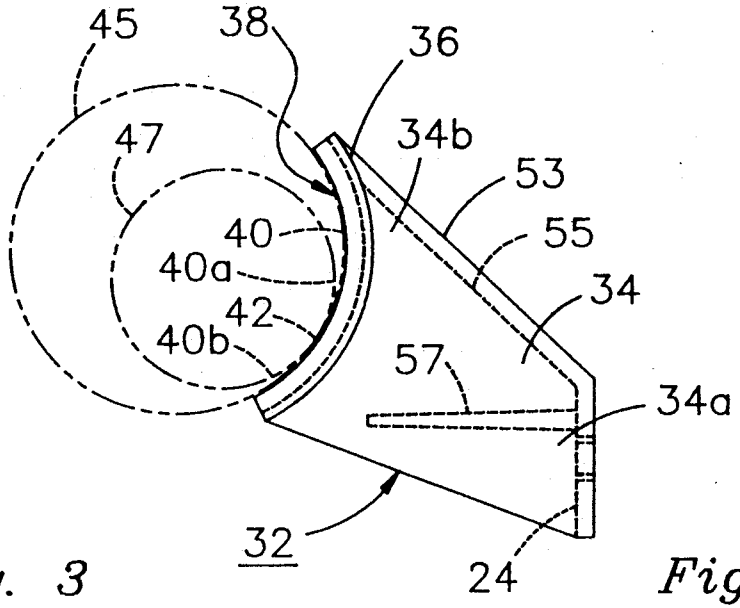
FIG. 4 is an end view of the fuse support of FIG. 3.

The support is capable of being used with a wide variety of fuses or other electrical devices having tubes of different diameters. This capability results, in part, from the fact that the arcuate outer surface 38, as best shown in FIG. 4, comprises two portions 40 and 42 having different radii of curvature. Portion 40 comprises two segments 40*a* and 40*b* disposed on the periphery of a first reference cylinder (45, FIG. 4) having a relatively large radius of curvature; and portion 42, which is located between segments 40*a* and 40*b*, is disposed on the periphery of a second reference cylinder 47 that has a relatively small radius of curvature. On portion 40 tubes of relatively large diameter are received in cradled relationship; and on portion 42 tubes of smaller diameter are received in cradled relationship.

Referring to FIG. 4, a typical larger-diameter fuse or other electrical device tube has an outer periphery coinciding with the reference cylinder 45, and a typical smaller-diameter fuse or other electrical device tube has an outer periphery coinciding with the reference cylinder 47. The periphery at 47 of the smaller-diameter fuse or other electrical device tube will substantially coincide with surface 42 over the entire angular extent of surface 42, and the periphery at 45 of the larger diameter fuse or other electrical device tube will substantially coincide with surface 40 over the entire angular extent of surface 40. The fuses of different manufacturers having ratings corresponding to the typical fuses depicted in FIG. 4 have fuse tube diameters differing by no more than 20 percent from those depicted, and these differences in diameters are sufficiently small that they do not significantly detract from the desired close comformity between the arcuate mounting surface and the fuse tube periphery.

In one embodiment of the invention, the fuse or other electrical device is fastened to the flanges 36 by a suitable adhesive. A thin layer of this adhesive is interposed between the tube periphery and the adjacent arcuate surface 40 or 42, and, this adhesive, when cured, bonds the tube to the flanges 36. To assist in obtaining a good bond between the tube and the flanges 36, after applying the adhesive, we typically apply a polymeric band (shown at 50 in FIGS. 1 and 2) around the tube and each flange and then suitably tighten this band to clamp the tube on the associated flange in closely-adjacent relationship. A lip 52 at the outer end of the flange prevents the band from accidentally slipping axially off the flange. Typically, we will remove the band after the adhesive has fully cured for example, by cutting the band.

We have located the arcuate portion 42 having the smaller radius of curvature centrally of the arcuate portion 40 having the larger radius of curvature primarily in order to increase the likelihood that any smaller diameter tube carried by the support will be correctly positioned on the support to provide appropriate electrical clearances around the supported fuse or other electrical device.

In another embodiment of the invention, we omit the above-described adhesive and rely entirely upon the bands 50 for fastening the tube to the flanges 36 of the fuse support 20. In this embodiment, the bands are not cut but are left intact so that they can hold the fuse or other electrical device in place during operation of the electrical apparatus. An advantage of this approach is that if the fuse or other electrical device should subsequently blow, then it can be easily replaced without disturbing the support. This is accomplished by cutting the bands 50, removing the fuse or other electrical device, substituting a new fuse or other electrical device, and then applying new polymeric bands corresponding to polymeric bands 50.

A typical application for the illustrated support is in a distribution transformer of the pole type. The pole-type distribution transformer which typically has the most severe space restrictions is a design in which there are a circuit breaker and a lightning arrester component mounted atop the usual core-and-coil assembly of the transformer at opposite sides of the core-and-coil assembly. A limited amount of space for the fuse or other electrical device is still available at the top of the core-and-coil assembly in a position between the circuit breaker and the arrester component, provided the fuse or other electrical device is carefully positioned to provide the required electrical strike (or clearance) distances around the tube. To enable the fuse or other electrical device to be so positioned, we have laterally offset the outer mounting surface 38 from the base 24. This lateral offset can best be seen in FIG. 4, where one edge 53 of the leg 32, considered in the direction of the base width, extends laterally away from the base.

Figure 3:
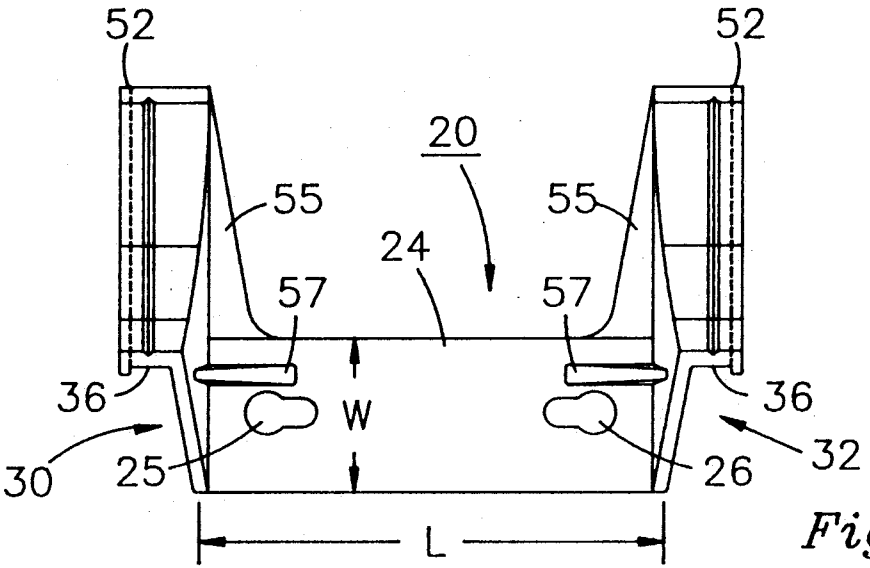
FIG. 3 is an enlarged plan view of the support of FIG. 1, but without the fuse or other electrical device of FIG. 1.

For imparting additional mechanical strength to the support, we provide each of the legs 30 and 32 with two integral reinforcing gussets 55 and 57. One of these gussets 55 is located at one edge 53 of the body portion 34 of the associated leg and has a length which extends along the length of the body portion 34, projecting from the body portion in a direction that extends longitudinally of the base 24. This gusset 55 is integral with the body portion 34 of the leg and is also integral with the base 24 at the proximate end of the body portion. As best seen in FIG. 3, gusset 55 has a width that gradually decreases, progressing along the length of the gusset from the proximate to the distal end of the body portion 34.

Figure 5:
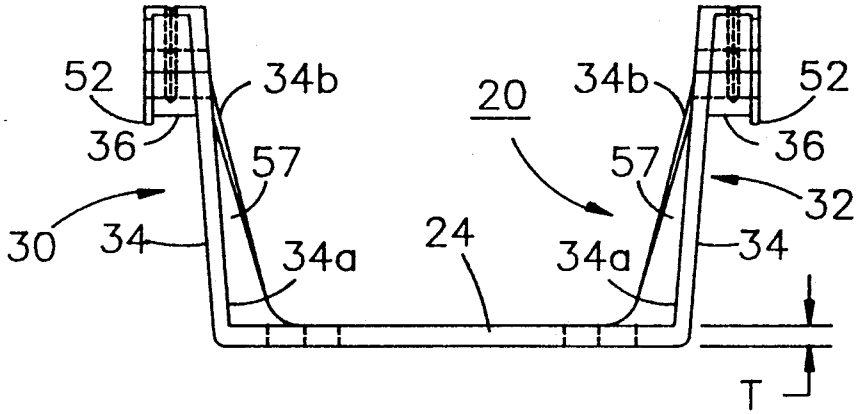
FIG. 5 is a side elevational view of the fuse support of FIG. 3.

The other gusset 57 is spaced from the first gusset 55 and also projects from the body portion 34 of the leg longitudinally of base 24. This second gusset 57 extends along the length of the body portion from the proximate end of the body portion to a point near its distal end. This gusset 57 is integral with base 24 at the proximate end of the body portion. As shown in FIG. 5, gusset 57 also has a width that gradually decreases, progressing along its length from the proximate to the distal end of the body portion.

As noted hereinabove, the support must be durable enough to successfully withstand without damage the shocks and other mechanical stresses produced by shipping, installation, and transportation of the electrical apparatus in which it is located. Our support has been subjected to numerous tests exposing it to such mechanical stresses, and it has successfully withstood them. For example, the support has been present in a pole-type distribution transformer dropped on a concrete floor from one foot heights, and it has been present in a distribution transformer shipped by truck across the United States and back; and it has remained intact despite these experiences and despite the fact that a ten pound fuse was being supported thereon during these tests. Part of this durability we attribute to the gussets 55 and 57 used for reinforcing the legs 30 and 32 of the support. Other factors contributing to this durability are the wall thickness of the legs and the material used for the support. In one embodiment, we use for the material of the support a substantially rigid thermosetting polyester compound. This polyester compound is especially advantageous in view of its superior ability to retain its mechanical properties with little degradation as it ages under hot oil. This latter property is important because in many of the transformer applications for the support, the support is located under the usual relatively-hot oil within the transformer.

Installation of our support can be accomplished quickly and easily simply by mounting its base against a predetermined support surface by two screws extending through the holes 25 and 26. A common type of prior art support comprises two separate components, each similar in a general way to our legs 30 and 32. It is necessary when using such components to achieve close alignment between them to enable the fuse or other electrical device to be properly mounted on them. We avoid the need for employing such an alignment step by an installer because we employ a one-piece design that is formed in a mold where the required alignment is already present.

Because we use a one-piece molded polymeric component as our support and join the fuse, or other electrical device, to it with adhesives or oil compatible polymeric bands, string, or tape there is no need to include screws, bolts, or other metallic fastening devices in the vicinity of the supported electrical device. This contributes to reduced costs and to greater dielectric strength in the vicinity of the electrical device.

Figure 6:
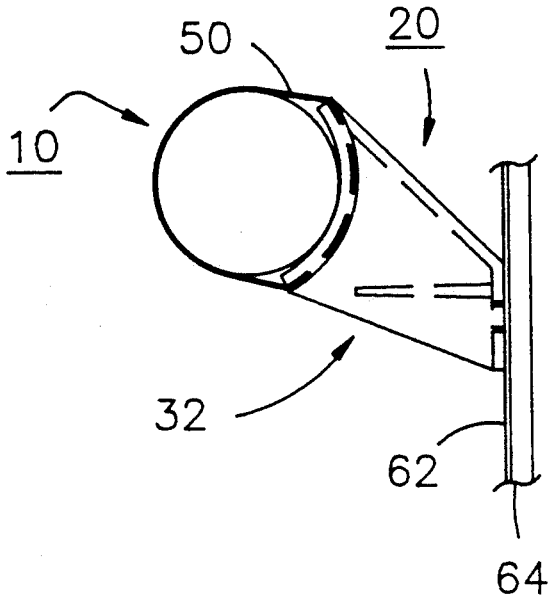
FIG. 6 shows the assembly of FIG. 1 mounted in a modified orientation.
Figure 7:
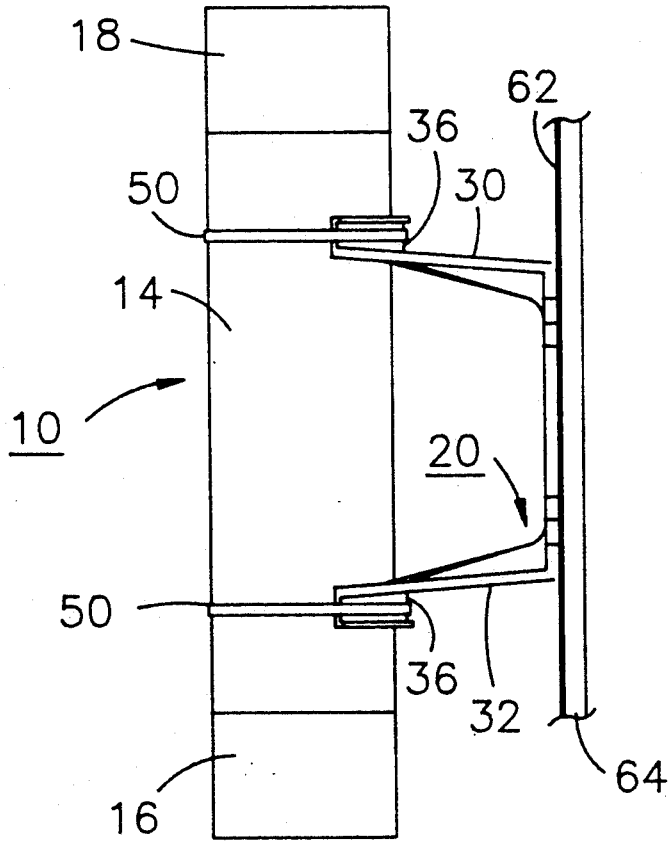
FIG. 7 shows the assembly of FIG. 1 mounted in another modified orientation.

Although we have shown in FIGS. 1 and 2 an assembly in which the axis of the fuse (10) extends horizontally and the base 24 of the fuse support is fixed to a horizontal supporting surface (60), our fuse support is easily adapted to other orientations of the fuse and the supporting surface. For example, in FIG. 6 we show how our support (20) can be used to mount a horizontally-extending fuse or other electrical device (10) on a vertical supporting surface 62 formed by a vertically-extending wall (64). As another example, we show in FIG. 7 how our support (20) can be used to mount a vertically-extending fuse or other electrical device (10) on the vertical supporting surface 62.

In each of these orientations, the support has exhibited outstanding ability to withstand shocks and other mechanical stresses while carrying an electrical device oriented as shown. However, the best mechanical performance has been achieved with the fuse or other electrical device mounted as shown in FIG. 1, i.e., with the electrical device extending horizontally and the base 24 of the fuse support also extending horizontally.

In describing a typical embodiment hereinabove, the flexible securing means 50 that surrounds the tube 14 and flange 36 has been described as a polymeric band. It is to be understood that our invention in its broader aspects comprehends the use in this location of other similar forms of securing means, such as string or tape of electrical insulating material.

While we have shown and described particular embodiments of the invention, it will be obvious to those skilled in the art that various changes and modifications may be made without departing from the invention in its broader aspects; and we, therefore, intend herein to cover all such changes and modifications as fall within the true spirit and scope of our invention.

What we claim as new and desire to secure by Letters of Patent of the United States is:

1. A support for mounting on structure of electrical apparatus an electric fuse or other electrical device that comprises a cylindrical tube and conductive terminals at opposite ends of the tube, said support comprising:

(a) a base that is adapted to be secured to said structure, said base having a length dimension and a width dimension, (b) two legs projecting laterally from said base at longitudinally opposite ends of the base, each leg comprising a body portion that has a proximate and a distal end, the body portion being integrally joined to said base at the proximate end of the body portion, each leg further comprising a flange at the distal end of said body portion that projects from said body portion and extends longitudinally with respect to said base, and in which:

(c) each of said flanges has a concave arcuate surface facing away from said base that is adapted to receive a portion of the cylindrical tube, (d) said arcuate surface includes a first curved portion for receiving a relatively large diameter tube and another curved portion for receiving a relatively small diameter tube, and (e) said base and said legs are of rigid polymeric electrical insulating material.

2. The support of claim 1 in which said first curved portion has a relatively large radius of curvature and said other curved portion has a relatively small radius of curvature.

3. A support as defined in claim 1 in which:

(a) said concave arcuate sufaces are laterally offset from said base in the direction of the base width, (b) each leg includes a first gusset integral with the body portion of said leg and having a length extending along one edge of said body portion, said first gusset projecting from its associated body portion in a direction extending longitudinally of said base and being integral with said base at the proximate end of said body portion.

4. A support as defined in claim 3 in which said gusset has a width that gradually decreases progressing along the length of the gusset from said proximate to said distal end of the associated body portion.

5. A support as defined in claim 3 in which each said leg includes a second gusset spaced from said first gusset, projecting from the body portion of said leg, and extending along said body portion from said proximate end of the body portion to a point near the distal end of said body portion, said second gusset being integral with said base at the proximate end of said body portion.

6. The support of claim 5 in which said second gusset has a width that gradually decreases progressing along the length of said second gusset from said proximate to said distal end of the associated body portion.

7. The support of claim 1 in which said base contains holes extending therethrough for receiving fastening devices for attaching said base to said structure.

8. An assembly comprising:

(a) a support for mounting on structure of electrical apparatus an electric fuse or other electrical device that comprises a cylindrical tube and conductive terminals at opposite ends of the tube, said support comprising:

(a1) a base that is adapted to be secured to said structure, said base having a length dimension and a width dimension, (a2) two legs projecting laterally from said base at longitudinally opposite ends of the base, each leg comprising a body portion that has a proximate and a distal end, the body portion being integrally joined to said base at the proximate end of the body portion, each leg further comprising a flange at the distal end of said body portion that projects from said body portion and extends longitudinally with respect to said base, and in which:

(a3) each of said flanges has a concave arcuate surface facing away from said base that is adapted to receive a portion of the cylindrical tube, (a4) said arcuate surface includes a first curved portion for receiving a relatively large diameter tube and another curved portion for receiving a relatively small diameter tube, and (a5) said base and said legs are of rigid polymeric electrical insulating material, (b) an electrical device that comprises a cylindrical tube and conductive terminals at opposite ends of the tube, the tube extending between said legs and being supported on said concave arcuate surfaces of said flanges, and (c) means for securing said tube to said flanges.

9. The assembly of claim 8 in which said securing means comprises adhesive bonding said tube to said flanges.

10. The assembly of claim 8 in which said securing means comprises a pair of flexible insulating bands, each of which surrounds said tube and one of said flanges.

* * * * *

UNITED STATES PATENT AND TRADEMARK OFFICE

CERTIFICATE OF CORRECTION

PATENT NO. : 5,134,382

DATED : July 28, 1992

INVENTOR(S) : G.D. Davis et al

It is certified that error appears in the above-identified patent and that said Letters Patent is hereby corrected as shown below:

In Fig. 1 of the drawings, the reference numeral "49" should be changed to - 50 -

In Fig. 4 of the drawings, the dotted lead lines for reference numerals 40a and 40b should be extended to denote segments of surface portion 40.

Signed and Sealed this

Nineteenth Day of October, 1993

*Attest:*

Bruce Lehman

BRUCE LEHMAN

*Attesting Officer*

*Commissioner of Patents and Trademarks*